United States Patent [19]

Allum et al.

[11] Patent Number: 4,634,372

[45] Date of Patent: Jan. 6, 1987

[54] FLARE

[75] Inventors: Stephen M. Allum, Woking; David A. Chesters, Walton-on-Thames, both of England

[73] Assignee: The British Petroleum Company p.l.c., London, England

[21] Appl. No.: 707,228

[22] Filed: Mar. 1, 1985

[30] Foreign Application Priority Data

Mar. 2, 1984 [GB] United Kingdom ..... 8405575
Nov. 29, 1984 [GB] United Kingdom ..... 8430145

[51] Int. Cl.[4] ..... F23Q 9/00

[52] U.S. Cl. ..... 431/202; 239/505; 239/DIG. 7; 431/284

[58] Field of Search ..... 431/202, 284, 4, 354; 239/DIG. 7, 505, 506, 416.5

[56] References Cited

U.S. PATENT DOCUMENTS 3,709,654 1/1973 Desty et al. .
3,833,337 9/1974 Desty ..... 431/284
3,915,622 10/1975 Desty et al. ..... 431/284
4,021,189 5/1977 Swann et al. ..... 431/202
4,073,613 2/1978 Desty ..... 431/202
4,099,908 7/1978 Beckmann et al. ..... 431/202
4,344,751 8/1982 Chesters ..... 431/202

FOREIGN PATENT DOCUMENTS 2220884 7/1973 Fed. Rep. of Germany ..... 431/202
1421765 1/1976 United Kingdom .

*Primary Examiner*—Samuel Scott
*Assistant Examiner*—H. A. Odar
*Attorney, Agent, or Firm*—Morgan, & Finnegan

[57] ABSTRACT

A Coanda flare for disposing of gas-liquid combustible materials has a Coanda body of the external type positioned across a high pressure line to form an annular slot. The annular slot acts as an outlet for high pressure gas-liquid combustible materials and directs the issuing materials over the outer surface of the Coanda body thereby entraining surrounding air. The ratio of the radius of curvature of the Coanda body to the annular slot width is in the range 4 to 100 and the ratio of the diameter of the high pressure line to the radius of curvature of the Coanda body is in the range 0.2 to 25.

5 Claims, 9 Drawing Figures

FLARE

The present invention relates to a method of disposing of combustible materials and more particularly relates to the disposal of gas/liquid combustible materials.

As offshore exploration proceeds, gas bearing fields are discovered which have a significant percentage of condensate associated with them and where the condensate is processed offshore. Occasionally say for operational reasons or in an emergency relief situation it is necessary to burn off the gas and condensate safely with low radiation and low or no liquid dropout. Current operational burners dispose of the liquid condensate separately from the gas and usually utilise high pressure air or gas to atomise the liquid and are often fan assisted giving a normally loose smokey and radiative flame.

The present invention relates to a flare suitable for disposing of combustible gas-liquid materials which thereby reduces the need for separate gas and liquid flares.

Thus according to the present invention there is provided a flare for disposing of gas-liquid combustible materials the flare comprising a Coanda body of the external type positioned across a high pressure line so as to define an annular outlet adapted to direct the issuing combustible materials over the outer surface of the Coanda body in which the ratio of the radius of curvature of the Coanda body to the annular outlet width is in the range 4 to 100 and the ratio of the diameter of the high pressure gas line to the radius of curvature of the Coanda body is in the range 0.2 to 25.

It is known that when the extension of one lip of the mouth of a slot through which a fluid emerges under pressure, progressively diverges from the axis of the slot, the stream of fluid emerging through the slot tends to stick to the extended lip thus creating a pressure drop in the surrounding fluid thus causing fluid flow towards the low pressure region. This physical phenomenon is known as the Coanda effect and a body exhibiting this effect is known as a Coanda body. The Coanda body usually is of (a) the internal venturi-shaped type in which the pressurised fluid emerges from an orifice near the throat of the venturi and passes towards the mouth or (b) the external type in which the pressurised fluid emerges from an orifice and passes outwards over an external director surface of a Coanda body. The present invention uses a Coanda body of type (b).

The diameter of the high pressure gas line adjacent to the annular outlet and the annular outlet width defines the exhaust flow area of the flare.

Preferably the Coanda surface has a step or projection close to the outlet. Preferably the step height is greater than or equal to the slot width and most preferably the step height is from one to three times the slot width.

A flare according to the invention is suitable for disposing of gas-liquid combustible materials containing up to 70% by weight of liquid with smokeless or relatively smokeless combustion.

The invention also includes a method of disposing of gas-liquid combustible materials in which (a) the combustible materials are passed through the annular outlet of a flare as hereinbefore described whereby the combustible materials entrain surrounding air by passing over the Coanda surface and (b) the resultant combustible mixture being ignited so as to burn above or adjacent to the Coanda body.

The invention will now be described by way of example only and with reference to FIGS. 1 to 9 of the accompanying drawings.

Figure 1:
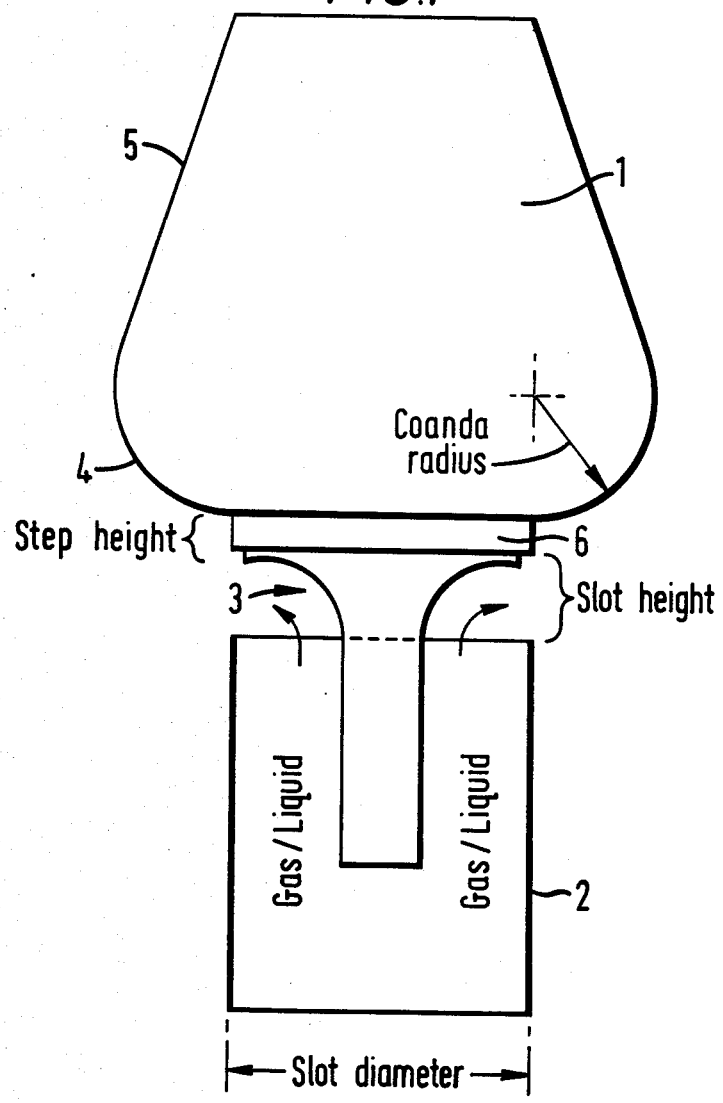
FIG. 1 shows a schematic diagram of an external Coanda flare tip.

A flarestack tip comprises a Coanda body 1 and a line 2 for the supply of high pressure combustible material. The Coanda body is positioned across the outlet of the line to form an annular outlet slot 3.

Preferably the initial portion of the Coanda body is the surface of revolution formed by the rotation of a quadrant of a circle about the vertical axis of the Coanda body, the fuel gas outlet or slot being tangential to the curved section of the quadrant.

It is known that a stream of gas will "stick" to a suitably shaped surface (a Coanda surface) when gas emerges at pressure from a slot adjacent to that surface. This Coanda effect produces a zone of low pressure thus entraining atmospheric air into the high velocity fuel stream.

The Coanda body 1 has a director surface comprising a deflector portion 4 which turns the direction of the high pressure gas from horizontal to vertical and leads to a tapered portion 5 which transmits the flow from the deflector portion to the top of the body.

The Coanda body 1 may be provided with a step 6 on its surface near to the outlet slot to provide more desirable flow characteristics.

The flares used were of the external Coanda type and three flares were used:

(a) An external Coanda flare having a lip ring diameter 97.5 mm, and Coanda radius of 50 mm.

(b) An external Coanda flare having a lip ring diameter 200 mm, and Coanda radius of 97.5 mm.

(c) An external Coanda flare having a lip ring diameter 97.5 mm, Coanda radius 97.5 mm.

For all three flares several slot widths were tested, usually 1, 3, 5 and 7 mm. Flares (a) and (c) were also run with several step heights; the inclusion of a step increases the limiting flow of the flare. Flare (b) was run without a step on the Coanda surface.

Figure 2:
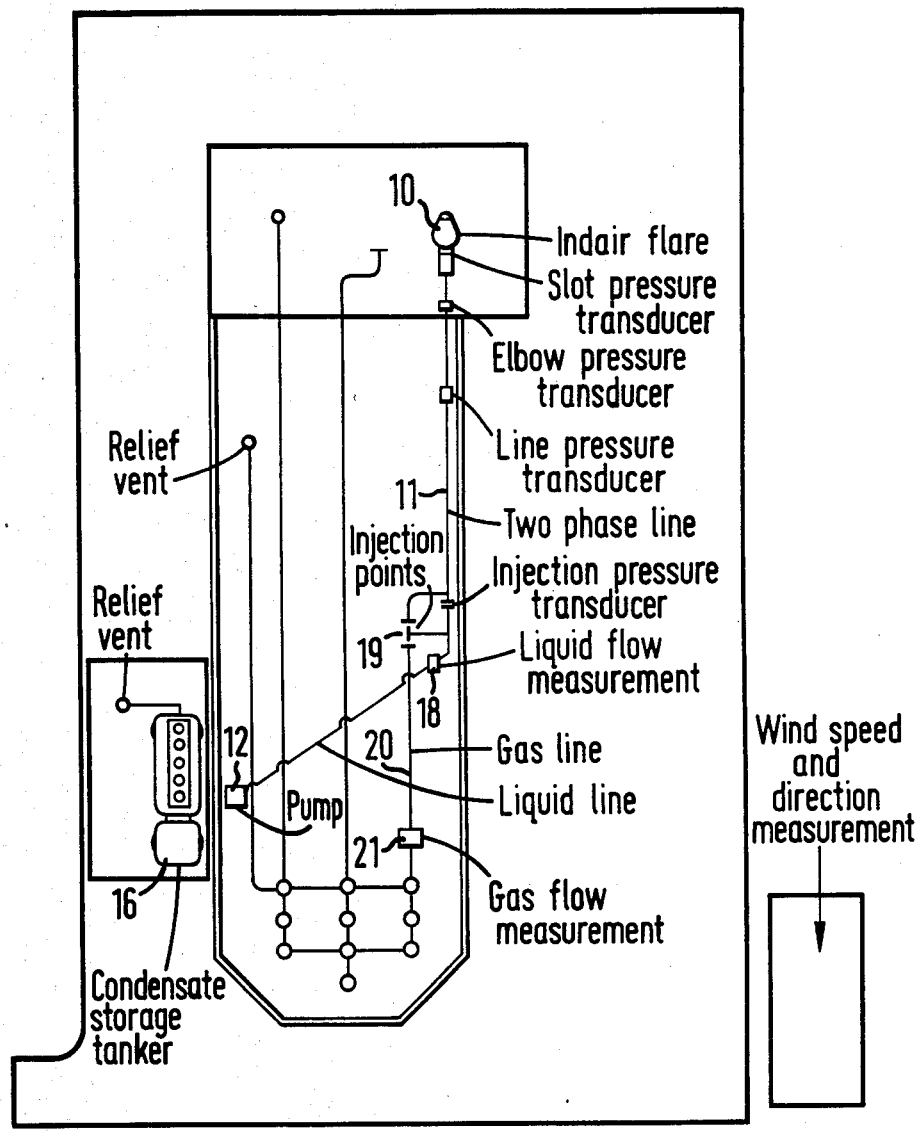
FIG. 2 shows a schematic layout of a flare with associated ancillary apparatus.

A natural gas condensate supply system is shown in FIG. 2 and consisted of (a) a 11,250 liter tanker 16 set inside a low bund designed to contain any spillage, (b) a pump 17 delivering a maximum flow rate of 150 liters per minute at a pressure of 150 psig, (c) a differential orifice flow measurement section 18 to measure flowrates of up to 150 liters per minute, (d) an injection point 19 in the form of a simple T section upstream of which was a non-return valve preventing gas from entering the liquid line.

A methane supply system consisted of (a) a pressurised supply line 20, (b) two block valves, (c) one gate valve for controlling the flow, (d) a critical orifice 21 for measuring the flow, (e) a relief valve.

The injection point for the condensate into the gas stream was located such that there would be several 'obstacles' in the path of the two phase mixture. These obstacles took the form of two right angled bends in the pipeline and simulate conditions encountered in practical installations. There was 20 meters of straight line downstream of the bends which is sufficient for a flow regime to stabilise.

During use, the flare was lit and the gas flow (methane) through the line 11 was increased to a pre-selected value. At this stage, the liquid condensate supply was isolated from line 11 such that the flare was burning dry gas only. The measurement and recording instrumentation were set to continuously scan all of the necessary parameters. The condensate was gradually introduced to the line 11 by use of pump 17 to form a gas-liquid combustible material and the flow slowly increased with frequent pauses to allow conditions in the pipe and at the flare to stabilise. The experiment was halted when stability of the Coanda stream was lost. The flare 10 was burnt on gas only until the line 11 was drained of any residual liquid, then the gas supply was isolated and a new set of conditions chosen.

Two line sizes were used to enable a wide range of gas velocities and pressure drops to be tested. The lines were 100 mm and 50 mms internal diameter. The pressure measurement points were at identical positions for both lines.

By varying the parameters of slot width, step height, Coanda radius, gas flow and slot pressure the limiting flow characteristics of two phase systems were established.

Figure 3:
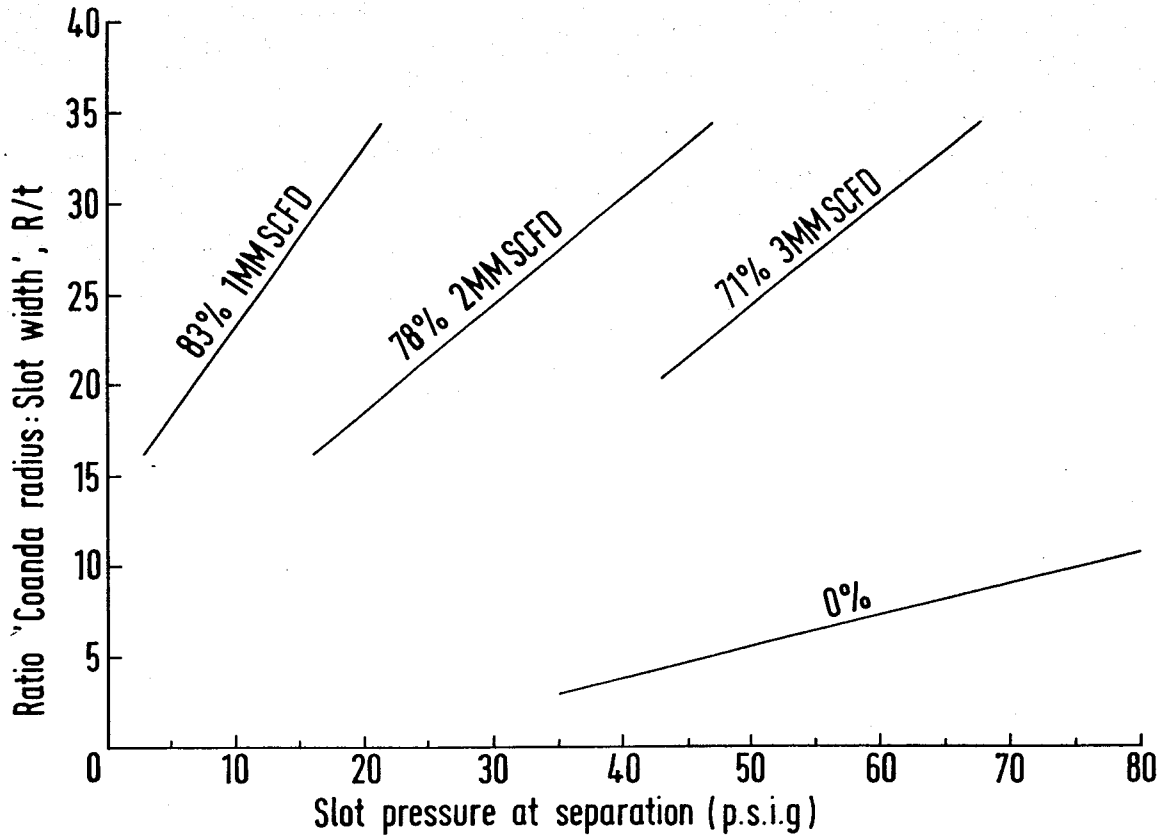
FIGS 3, 4 and 5 show graphs of Coanda radius/slot width and slot pressure for flare (c).
Figure 4:
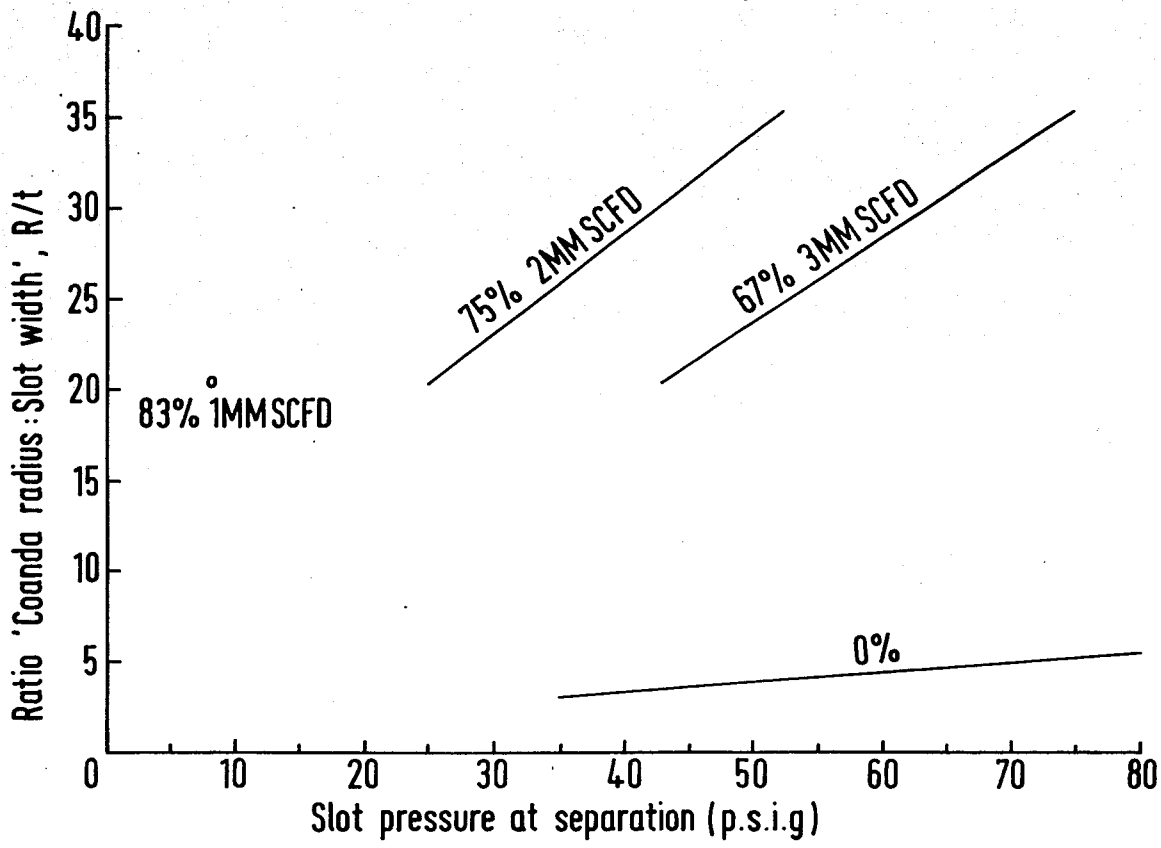
Figure 5:
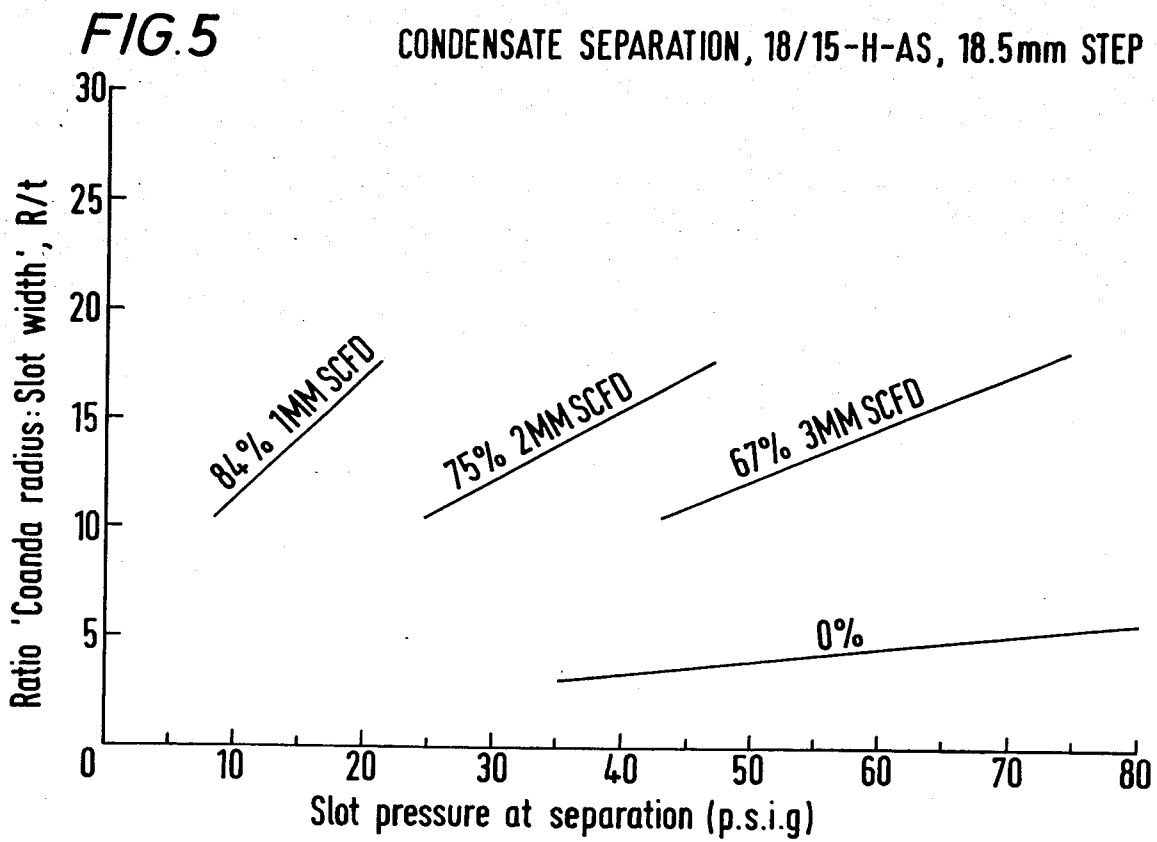

FIGS. 3, 4 and 5 shows graphs of Coanda radius/slot width against the Coanda slot pressure at separation for flare (c) for step heights of zero, 12 mm and 18.5 mm respectively. The slot widths used were 1 mm, 3 mm, 5 mm and 7 mm.

Figure 6:
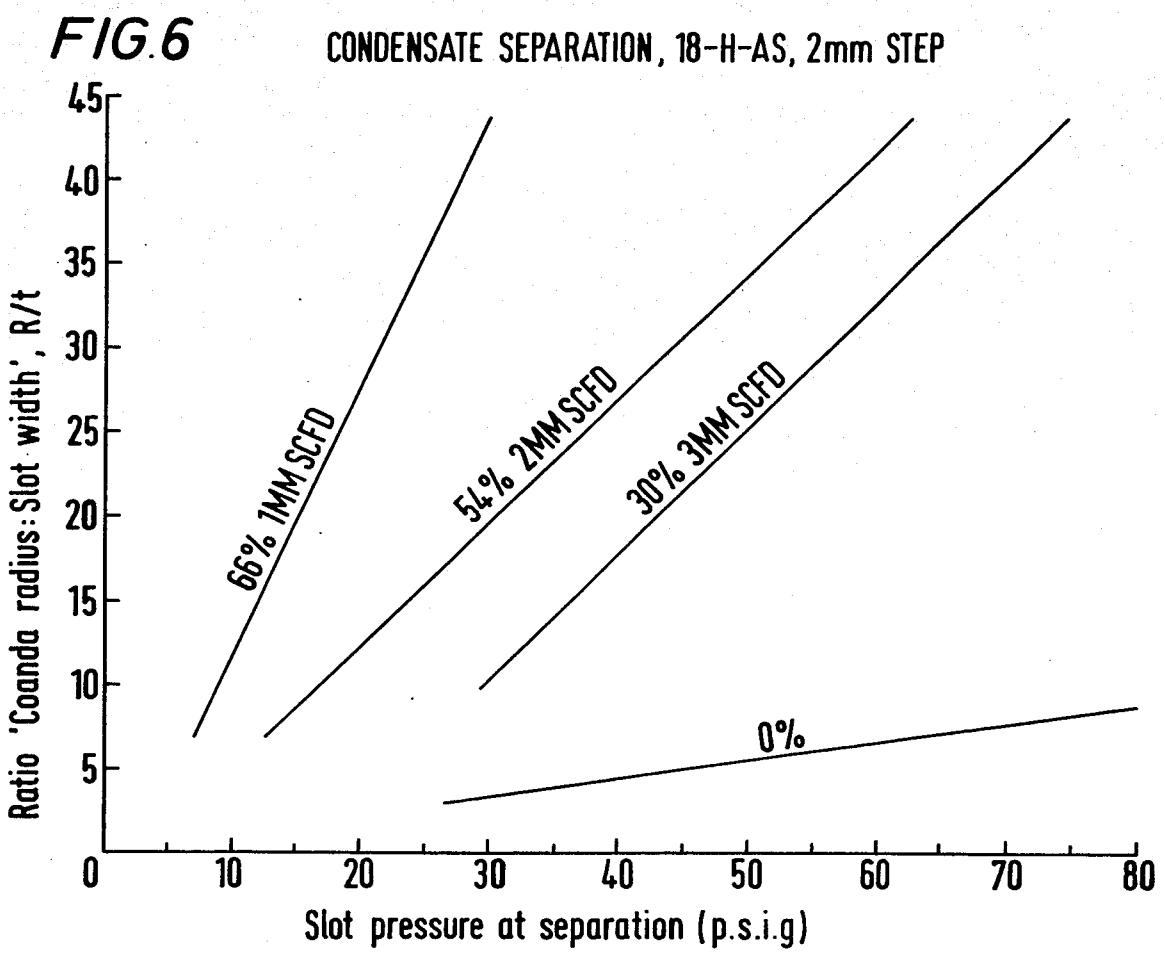
FIGS. 6, 7 and 8 shows graphs of Coanda radius/slot width for flare (a).
Figure 7:
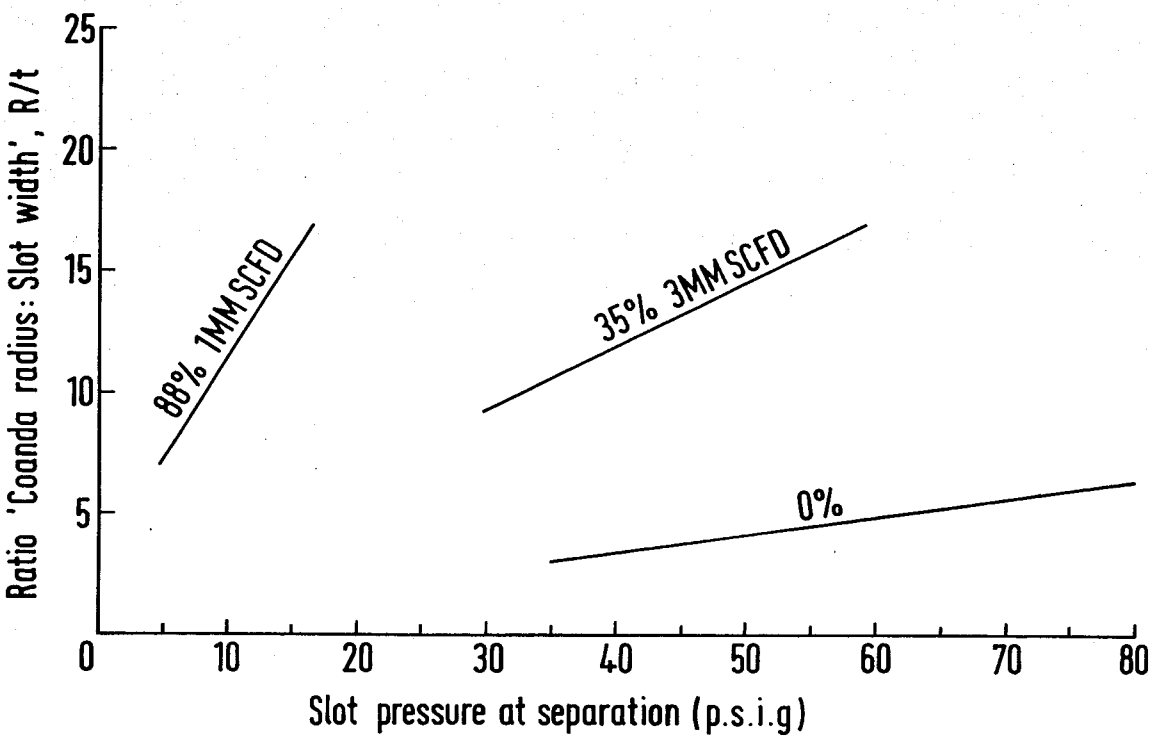
Figure 8:
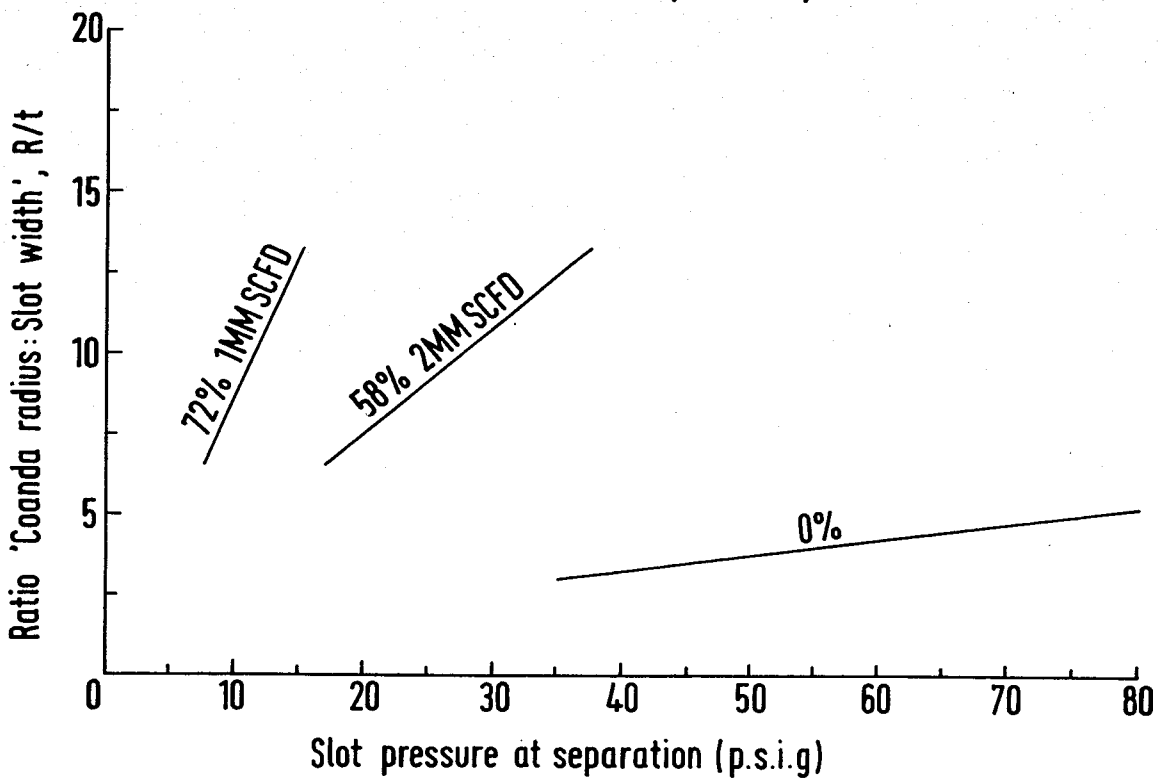

FIGS. 6, 7 and 8 shows graphs of Coanda radius/slot width for flare (a) for step heights of 2 mm, 8 mm and 14 mm. Similar slot widths were used.

Figure 9:
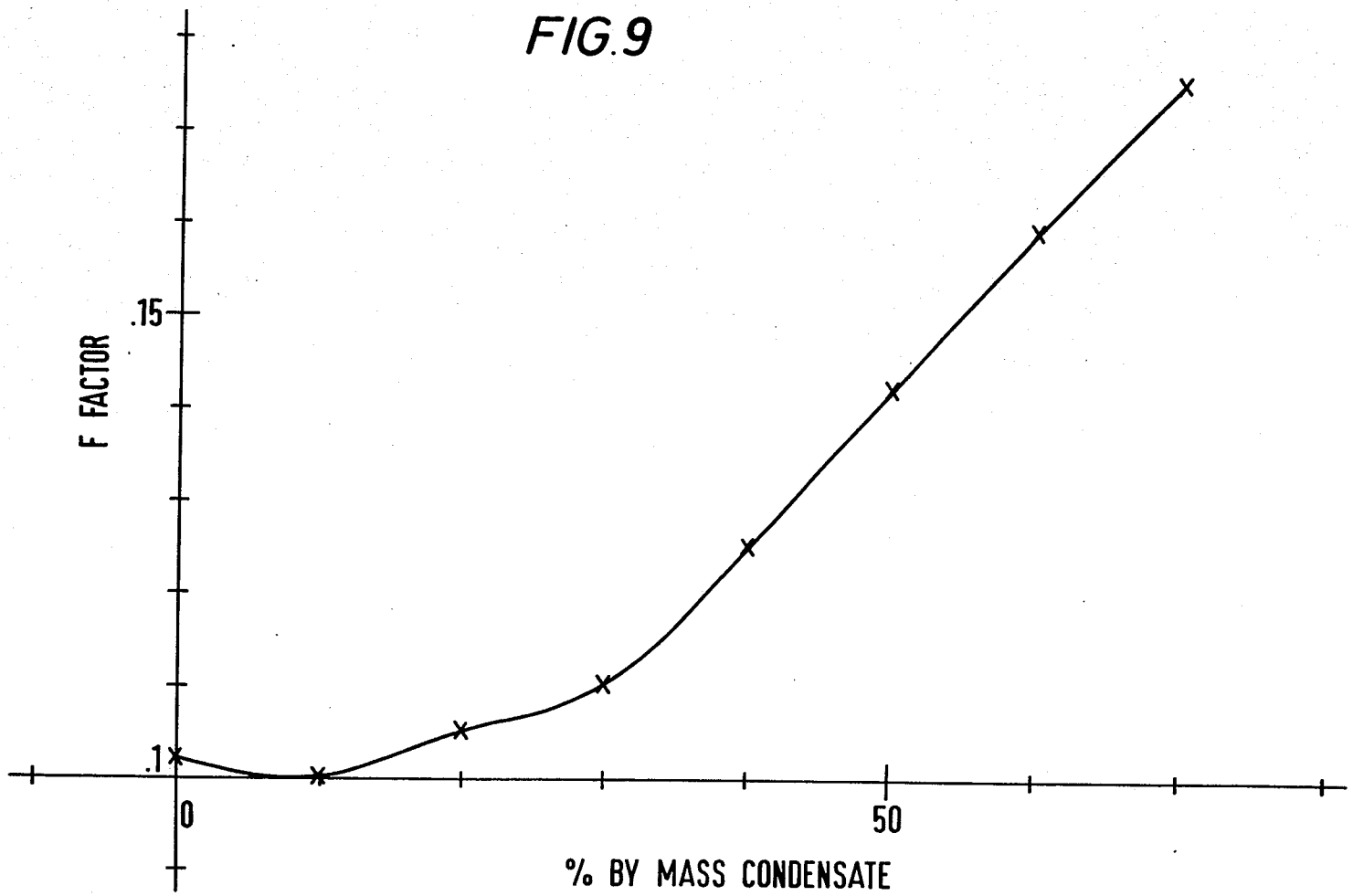
FIG. 9 shows a graph of F-factor and percentage by mass of condensate in the flare fuel supply.

FIG. 9 shows a graph of F-factor and percentage by mass of condensate in the fuel supply for flare (a). The F-factor is the fraction of heat produced from the flare which is radiant in form.

It is believed that the Coanda effect operates to atomise the liquid into fine droplets. It is desirable that the two-phase regime within the flare is annular or annular mist flow. High shear forces through the slot break up the liquid into small droplets. The high velocity fluids create a low pressure region on either side of the jet. The low pressure region against the Coanda surface causes the fluids to follow the contours of the surface. The low pressure region on the opposite side of the jet entrains large amounts of air into the fluids to produce the clean combustion typical of Coanda flares.

The results indicate that the slot pressure at which separation of the fluid stream from the Coanda surface takes place is increased by the use of the step and by the use of a greater Coanda radius.

The fraction of heat produced which is radiant in form does not change significantly with mass condensate fractions of 0% to 30%.

Existing equipment requires the supply of utilities in the form of high pressure air/gas for liquid atomisation plus power of the fan assist. The difficulties with current facilities include loose, smokey flame and liquid dropout. By contrast the Coanda burner tends to fully atomise the liquid even at low slot pressures.

We claim:

1. A Coanda flare for the simultaneous disposal of gas-liquid combustible materials containing up to 70% by weight of liquid comprising (a) a supply line for pressurized gas-liquid combustible materials (b) a Coanda body having an outer surface positioned across the supply line so as to define an annular outlet adapted to direct the gas-liquid combustible materials issuing from the annular outlet over the outer surface of the Coanda body, (c) director outer surface of the Coanda body having a step located close to the annular outlet, the step height being equal to or greater than the width of the annular outlet, (d) the ratio of the radius of curvature of the Coanda body to the width of the annular outlet being in the range from 4 to 100 and the ratio of the diameter of the supply line to the radius of curvature of the Coanda body being in the range from 0.2 to 25.

2. Flare according to claim 1 in which the step or projection height is from one to three times the annular slot width.

3. Flare according to claim 1 in which the pressure at the annular outlet is from 10 to 70 p.s.i.g.

4. A method disposing of gas-liquid combustible materials in which (a) the combustible materials are passed through the annular outlet of a flare whereby the combustible materials entrain surrounding air by passing over a Coanda body (b) the resultant combustible mixture being ignited so as to burn above or adjacent to the Coanda body, said flare comprising (a) a supply line for pressurized gas-liquid combustible materials, (b) said Coanda body having an outer surface positioned across the supply line so as to define an annular outlet adapted to direct the gas-liquid combustible materials issuing from the annular outlet over the outer surface of the Coanda body, (c) the outer surface of the Coanda body having a step located close to the annular outlet, the step height being equal to or greater than the width of the annular outlet, (d) the ratio of the radius of curvature of the Coanda body to the width of the annular outlet being in the range from 4 to 100 and the ratio of the diameter of the supply line to the radius of curvature of the Coanda body being in the range from 0.2 to 25.

5. A method according to claim 4 in which the pressure at the annular outlet is from 10 to 70 p.s.i.g.

* * * * *